US009428988B2

(12) United States Patent
Frazier

(10) Patent No.: US 9,428,988 B2
(45) Date of Patent: Aug. 30, 2016

(54) HYDROCARBON WELL AND TECHNIQUE FOR PERFORATING CASING TOE

(75) Inventor: W. Lynn Frazier, Corpus Christi, TX (US)

(73) Assignee: MAGNUM OIL TOOLS INTERNATIONAL, LTD., Corpus Christi, TX (US)

( * ) Notice: Subject to any disclaimer, the term of this patent is extended or adjusted under 35 U.S.C. 154(b) by 1072 days.

(21) Appl. No.: 13/134,819

(22) Filed: Jun. 17, 2011

(65) Prior Publication Data

US 2012/0318507 A1 Dec. 20, 2012

(51) Int. Cl.

| | |
|---|---|
| ***E21B 33/14*** | (2006.01) |
| ***E21B 43/11*** | (2006.01) |
| ***E21B 43/26*** | (2006.01) |
| ***E21B 34/06*** | (2006.01) |

(52) U.S. Cl.

CPC ..... *E21B 33/14* (2013.01); *E21B 34/063* (2013.01); *E21B 43/11* (2013.01); *E21B 43/26* (2013.01)

(58) Field of Classification Search

CPC .... E21B 33/14; E21B 34/063; E21B 34/085; E21B 43/26; E21B 43/114; E21B 43/11
USPC ..... 166/376, 287, 297, 242.8, 329, 317
See application file for complete search history.

(56) References Cited

U.S. PATENT DOCUMENTS

| | | | | |
|---|---|---|---|---|
| 2,707,997 | A | 5/1955 | Zandmer | |
| 4,673,039 | A | 6/1987 | Mohaupt | |
| 5,103,911 | A | 4/1992 | Heijnen | |
| 5,425,424 | A | 6/1995 | Reinhardt | |
| 5,526,881 | A * | 6/1996 | Martin et al. | 166/296 |
| 6,047,773 | A | 4/2000 | Zeltmann | |
| 6,095,247 | A * | 8/2000 | Streich et al. | 166/299 |
| 6,237,688 | B1 * | 5/2001 | Burleson et al. | 166/281 |
| 6,397,950 | B1 | 6/2002 | Streich | |
| 6,561,275 | B2 * | 5/2003 | Glass et al. | 166/317 |
| 6,702,019 | B2 | 3/2004 | Dusterhoft | |
| 6,772,837 | B2 | 8/2004 | Dusterhoft | |
| 6,932,157 | B2 | 8/2005 | McGregor | |
| 7,640,988 | B2 | 1/2010 | Phi | |
| 7,699,101 | B2 * | 4/2010 | Fripp et al. | 166/229 |
| 7,784,543 | B2 * | 8/2010 | Johnson | 166/296 |
| 7,802,627 | B2 | 9/2010 | Hofman | |
| 8,020,620 | B2 * | 9/2011 | Daniels et al. | 166/297 |
| 8,231,947 | B2 * | 7/2012 | Vaidya et al. | 428/34.1 |
| 8,297,364 | B2 * | 10/2012 | Agrawal et al. | 166/376 |
| 2006/0207763 | A1 | 9/2006 | Hofman | |
| 2011/0017453 | A1 | 1/2011 | Mytopher | |
| 2013/0062072 | A1 * | 3/2013 | Alvarez et al. | 166/376 |

FOREIGN PATENT DOCUMENTS

| | | |
|---|---|---|
| CA | 2692377 | 2/2010 |
| GB | 2452858 | 3/2009 |

* cited by examiner

*Primary Examiner* — Michael Wills, III
(74) *Attorney, Agent, or Firm* — G. Turner Moller

(57) ABSTRACT

A method and apparatus for completing a horizontal hydrocarbon well includes cementing a casing string in the well and creating passages through the casing string adjacent float equipment near the casing toe by slowly dissolving a plug with completion fluid used to pump cement into an annulus between the casing string and bore hole. By the time the cement sets up, the plug dissolves leaving passages in the casing string through which a first frac job may be pumped or which allows pumping perforating equipment into the horizontal leg without requiring a coiled tubing run. The technique can also be used in vertical wells to save a perforating gun run.

19 Claims, 2 Drawing Sheets

HYDROCARBON WELL AND TECHNIQUE FOR PERFORATING CASING TOE

This invention relates to a hydrocarbon well and a technique of fracing the well without having to make an initial coiled tubing run.

BACKGROUND OF THE INVENTION

There has been a paradigm shift in the oil and gas industry with the advent of drilling wells having a horizontal leg and then conducting multiple frac jobs along the horizontal leg. This has allowed the development of oil and gas bearing formations which were heretofore uneconomic. For some years, the fastest growing segment of hydrocarbon production in the United States has been from shales or very silty zones that previously have not been economic. The current areas of increasing activity include the Barnett Shale, the Haynesville Shale, the Fayetteville Shale, the Marcellus Shale, the Eagle Ford Shale and other shale or shaley formations. It is no exaggeration to say that the future of oil and gas production in the United States involves drilling horizontal wells and then conducting multiple frac jobs in the horizontal leg of the well. Any development that improves the efficiency or lowers the cost of drilling and completing multi-fraced horizontal wells is important to the production of oil and gas.

One standard technique for completing a horizontal well is to run a string of casing into the horizontal leg of the well and then cement the casing in place by pumping a first cementing plug through the casing followed by cement followed by a second cementing plug. Drilling mud in the annulus between the well bore and the casing is displaced and flows toward the surface and ultimately discharges into surface equipment. The first cementing plug ultimately lands in float equipment near the end of the casing string whereupon cement flows out of the casing, through passages in the float equipment and then flows in the annulus toward the surface. When the second cementing plug reaches the float equipment, it latches in place and prevents back flow of cement into the casing. Thus, at the end of a successful cement job, a sheath of cement sets up around the casing string from the float shoe or toe of the casing string toward or beyond the heel where the well bore turns horizontal.

Although there are a variety of ways to conduct frac jobs on a well, one standard technique is to perforate the horizontal well near the float shoe by running a perforating gun on coiled tubing to a location adjacent the float shoe, perforate the casing, pull the coiled tubing out of the well and then release the coiled tubing unit. This is called perforating the toe because the end of the casing string is sometimes referred to as the toe.

The next step in the standard technique is to pump into the well a perforating gun having a rubber sealing against the inside of the casing and shoot a set of frac perforations near the end of the casing string. It will be seen that it is necessary to perforate the toe because, otherwise, the inside of the casing string is pressure tight and the perforating equipment cannot be pumped into the well because there is no place for the liquid to escape that is in front of the perforating equipment. Thus, a coiled tubing run is necessary to transport a perforating gun to the toe so a set of frac perforations can be shot.

A first zone is fraced by pumping a slurry of water, chemicals and proppant through the casing and through the perforations into the hydrocarbon bearing formation. To conduct multiple frac jobs, the casing is perforated in a second location nearer the surface, a bridge plug is placed to isolate the zone that has been fraced and a second frac job is done by pumping frac fluids through the second set of perforations. This process is repeated until the desired number of fracs have been done.

It has been proposed to provide a system where the second cementing plug moves a sleeve and opens a port through the float shoe in the process of cementing a horizontal well. This theoretically provides a passage through the casing toe which allows a wire line perforating gun to be pumped into the well so a coiled tubing run is not required. One problem with this system is the cement has not set up when the port is opened, meaning that cement is often found inside the casing above the float equipment. This is a problem because the only known means of removing set up cement inside the casing string is with a bit on the end of a work string, which is usually a coiled tubing unit, meaning that the intended purpose of avoiding a coiled tubing run has been thwarted. In addition, it is not a good idea to remove cement from outside the casing, where it is needed, and let it flow into the casing where it is a problem.

Disclosures of interest relative to this invention are found in U.S. Pat. Nos. 2,707,997; 4,673,039; 5,103,911; 5,425,424; 6,047,773; 6,397,950; 7,640,988 and 7,802,627, U.S. Printed Patent Applications 2006/0207763 and 2011/0017453, Canada Patent 2,692,377 and Great Britain Patent 2,452,858.

SUMMARY OF THE INVENTION

In the disclosed technique, it is recognized that a coiled tubing run to perforate the casing toe can be eliminated. This is important because, at mid-2011 prices, a run-of-the-mill coiled tubing unit in South Texas costs $55,000-75,000/day, there is a one day minimum and is not cheaper elsewhere. Avoiding a $55,000-75,000 cost, at present prices, on every horizontal well is significant. Although the disclosed method and apparatus is particularly suited for horizontal wells, it can be used on vertical wells and thereby avoid the time and expense of a perforating gun run in preparation for fracing operations.

To this end, one or more passages are provided in the casing string which are blocked by a soluble plug. These passages can be provided in a sub or short joint provided for this purpose which is installed in the casing string near the toe. In some embodiments, the soluble plug is a water or acid soluble ball that is well known in the art. In these embodiments, the passage can provide a first valve seat cooperating with the soluble ball to provide a check valve preventing flow into the casing string and a second valve seat cooperating with the soluble ball to provide a second check valve preventing flow out of the casing.

After the casing string is cemented in the horizontal leg of the well and the second plug is pumped down and latched in float equipment, the rig used to drill the well is normally released so it can be moved to its next drilling location. By the time a completion attempt is made on the well, the cement has set up in the annulus between the well bore and the casing and the soluble plug has dissolved in the liquid used to pump the second cementing plug into the casing. Completion operations can then begin without requiring a coiled tubing run in the case of a horizontal well or a perforating gun run in the case of a vertical well because there are already passages open at a suitable location between the casing and the cement sheath surrounding the casing. In some embodiments, a wire line perforating gun can be pumped into the well to create perforations through which frac fluid can be pumped. In other embodiments, a frac job can be conducted through the passages provided by the soluble plug or plugs.

It is accordingly an object of this invention to provide an improved technique for completing a horizontal or vertical well.

A more specific object of this invention is to provide the capability of commencing completion operations in a horizontal well without requiring a coiled tubing run.

A further object of this invention is to provide an improved well installation and method of completing the well which is simpler, less expensive and quicker than existing approaches.

These and other objects and advantages of this invention will become more apparent as this description proceeds, reference being made to the accompanying drawings and appended claims.

DETAILED DESCRIPTION OF THE INVENTION

Figure 1:
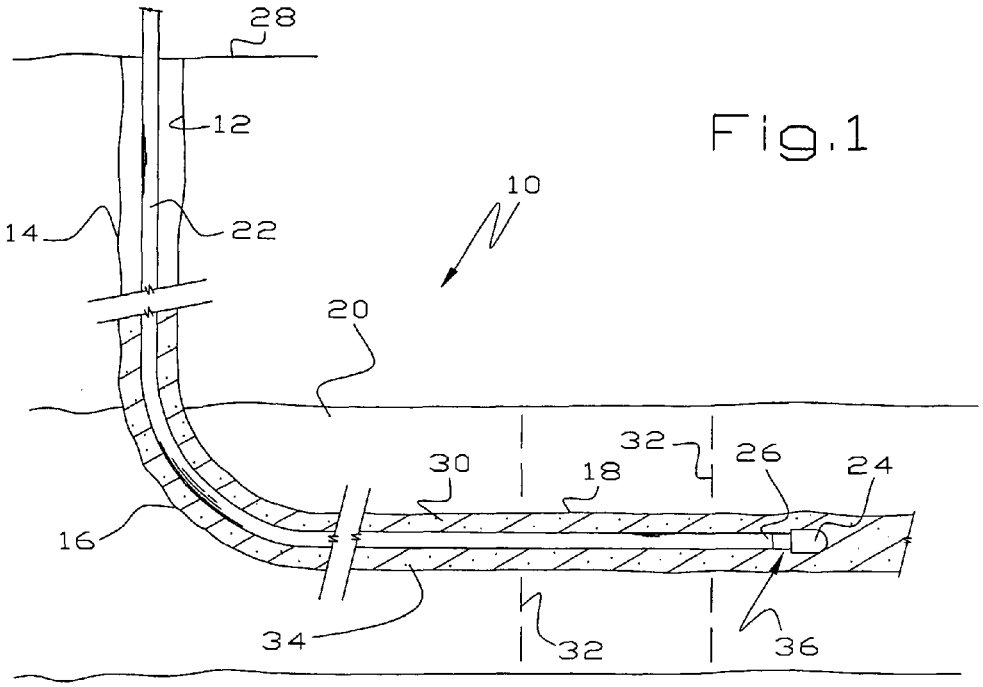
FIG. 1 is a simplified cross-sectional view of a horizontal hydrocarbon well illustrating the condition of the well immediately after cementing casing in the well.
Figure 2:
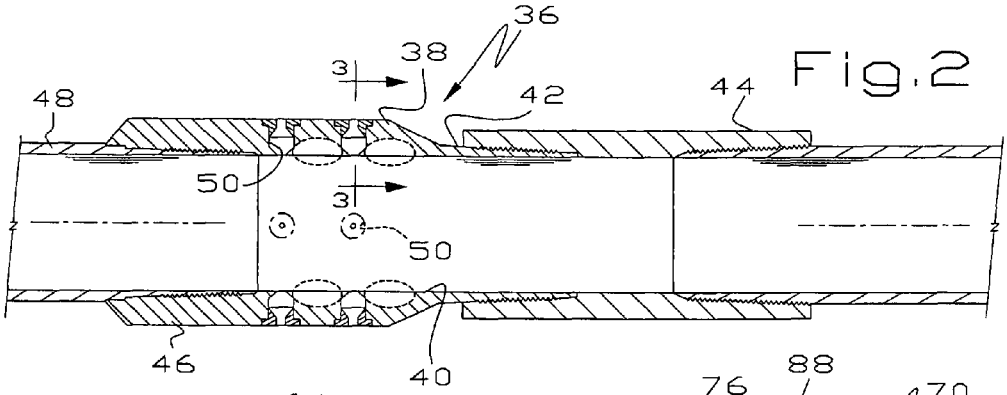
FIG. 2 is an enlarged longitudinal cross-sectional view of FIG. 1 illustrating a sub providing passages through its tubular wall that are plugged by a soluble element.
Figure 3:
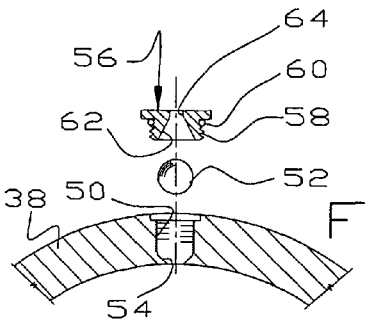
FIG. 3 is a transverse cross-sectional view of the sub of FIG. 2, taken substantially along line 3-3 thereof, as viewed in the direction indicated by the arrows.

Referring to FIGS. 1-3, a hydrocarbon well 10 includes a bore hole 12 drilled in the earth including a more-or-less vertical leg 14 transitioning through a heel 16 to a horizontal leg 18 which passes into an oil or gas bearing formation 20. As the bore hole is being drilled, one or more strings of surface pipe (not shown) and/or protection pipe (not shown) may be run and cemented in the bore hole 12. After the bore hole 12 is drilled, a casing string 22 is run into the well having float equipment at or adjacent an end or toe 26 of the casing string 22. The float equipment can include a float shoe 24 at the end of the casing string to receive both cementing plugs as shown in FIG. 1, can comprise other types of float equipment shown in FIG. 4 or can be of any other arrangement.

A first cementing plug (not shown) followed by cement is pumped down the casing string 22 while drilling fluid, usually known as drilling mud, in the bore hole 12 flows on the outside of the casing 22 toward the heel 16 and ultimately upwardly through the vertical leg 14 to the surface 28 where it is received and handled by suitable surface equipment (not shown). At the end of the cement batch, a second cementing plug (not shown) can be pumped into the casing string 22 to displace cement from inside the casing string 22 so it accumulates on the outside of the casing string 22 in an annulus 30 between the casing string 22 and the bore hole 12. The cementing plugs can come to rest in the float equipment 24 at or near the end of the casing 22 as shown in FIG. 1. The well 10 may include centralizers (not shown), scratchers (not shown) or other cementing accessories in the annulus 30 but the annulus 30 is not blocked so drilling mud and cement are capable of readily flowing from the end of the bore hole 12 to the surface.

Horizontal wells are typically completed by hydraulically fracturing the formation 20 to produce a series of vertical fractures spaced along the horizontal leg 18 as suggested by the dashed lines 32. The fractures 32 can be created in any suitable manner. Conventionally, the completion process begins by rigging up a coiled tubing unit on the well 10, attaching a wire line perforating gun to the coiled tubing and running the coiled tubing into the casing string 22 until is approaches the casing toe 26 near the float equipment 24. After perforating the casing string 22 adjacent the toe 26, the coiled tubing is removed from the well and the coiled tubing unit is rigged down and released.

A wire line perforating gun (not shown) or water jet assembly (not shown) is pumped into the casing 22 on a wire line until it reaches a desired location near the end of the casing string 22 where it is used to create a first set of frac perforations through the casing string 22 and the cement sheath 34. A bridge plug (not shown) may be set above the perforated casing toe 26 to isolate it from frac pressure. Pumping equipment (not shown) is rigged up to deliver a frac fluid through the casing string 22 to create a first fracture or a first set of fractures, depending on whether one interval has been perforated or whether several intervals have been perforated. By setting a bridge plug or other isolation tools between perforations, a series of fractures can be created in the horizontal leg 18. Those skilled in the art will recognize that the well 10 and the completion technique, as heretofore described, is typical of current techniques for completing a horizontal well.

Figure 4:
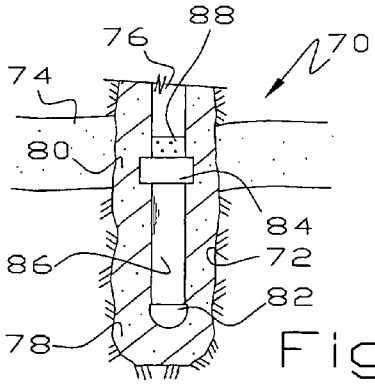
FIG. 4 is an enlarged view of the end of a vertical well illustrating slightly different float equipment.

Instead of rigging up and using a coiled tubing unit to create a set of perforations adjacent the casing toe 26, one or more passages are provided through the tubular wall of the casing string 22 which are sealed by a soluble plug. This may be accomplished by providing passages in a casing joint or collar but it can be done by providing a sub 36 inserted into the casing string 22 as shown in FIGS. 1-2. The sub 36 can accordingly comprise a body 38 having a passage 40 therethrough, a threaded pin 42 sized to be received in a collar 44 of a casing joint, float equipment or the like and a threaded box 46 sized to receive a pin end 48 of a casing joint. The sub 36 may be placed at any suitable location adjacent the casing toe 26 and is upstream or nearer the surface 28 than the most upstream float equipment 24 shown in FIG. 1 or as shown in FIG. 4. Although the sub 36 may be at any suitable location, as a practical matter, the sub 36 can typically be less than 150' from the end of the casing string 22 or less than 100' from the float equipment 24.

The sub 36 can comprise a series of passages 50 opening into the housing passage 40 and spaced axially and circumferentially around a central portion of the body 38. The sub 36 may be of any suitable length to provide room for a large number of passages 50, as desired. The passages 50 can be of any suitable shape to accommodate a soluble plug of any suitable size and shape. It may be preferred, however, that the soluble plug be a ball or sphere 52. Soluble balls are desirable because they are widely used in oil and gas wells for a variety of purposes, have undergone a considerable amount of development, have become very reliable and potential customers have already become comfortable using them. Soluble balls are commercially available from many different suppliers including Magnum Oil Tools International, LLC, Corpus Christi, Tex. under the name BIOBALLS to which reference is made for a more complete description thereof. These soluble balls are available as water soluble balls and/or acid soluble balls in a variety of operating pressure and temperature ranges.

To accommodate the balls 52, the passages 50 can include a first valve seat 54 acting to prevent flow from the annulus 30 into the housing passage 40. A retainer plug or cap 56 provides threads 58 to mate with the threaded passage 50 to compress a seal 60 while a valve seat 62 acts with the ball 52 to prevent flow from the housing passage 40 to the annulus 30. The plug 56 also includes an opening 64 completing a flow path through the plug 56 after the ball 52 dissolves. It will be seen that the soluble ball 52 acts as a valve preventing flow in either direction through the passage 50 while the well is being cemented and for a period that is long enough for the cement to set up.

Near the end of cementing the casing string 22 in the bore hole 12, some technique is used to displace cement from inside the casing string 22 so it accumulates on the outside in the annulus 30. Typically, a second cementing plug is pumped into the well followed by a completion fluid, which is typically water, 2% KCL water, field salt water, sea water or the like. In any event, the composition of the ball 52 and/or the composition of the completion fluid is selected so the ball 52 slowly dissolves in the completion fluid. The time interval to dissolve the ball 52 is subject to wide variation but is sufficiently long for the cement to set up to an extent where it is no longer flowable before the ball 52 is completely dissolved. This is typically not a problem because it takes at least several days to dismantle and move the drilling rig used to drill the bore hole 12, assemble the equipment necessary to complete the well and start the completion operation.

For a variety of reasons, the completion fluid may include an acid and have a very low pH, typically lower than three. In such an event, the composition of the soluble ball 52 can be selected to be acid soluble.

Figure 5:
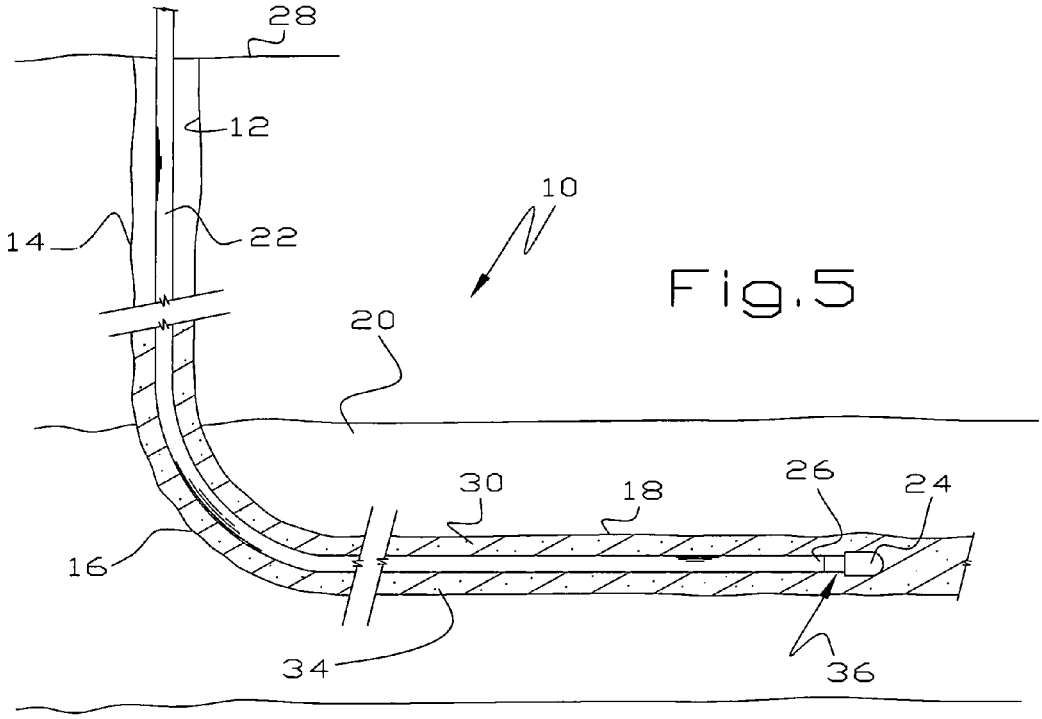
FIG. 5 is a view of a well illustrating an early step in conducting a series of fracing operations in the horizontal well of FIG. 1.

After the casing string 22 has been cemented in the bore hole 12, the drilling rig (not shown) used to drill the well 10 is released and moved from the location. After a period of time, in which the cement sets up, a completion attempt is made. During this interval, the ball 52 dissolves in the completion fluid thereby opening the passages 50. When it is desired to commence fracing operations, one of many approaches can be adopted. As shown in FIG. 5, if care is taken to position the sub 36 in an area where it is desired to conduct the first frac operation of the formation 20, the first frac operation can be conducted through the passages 50 simply by pumping a frac fluid down the casing string 22 and out through the passages 50.

Figure 6:
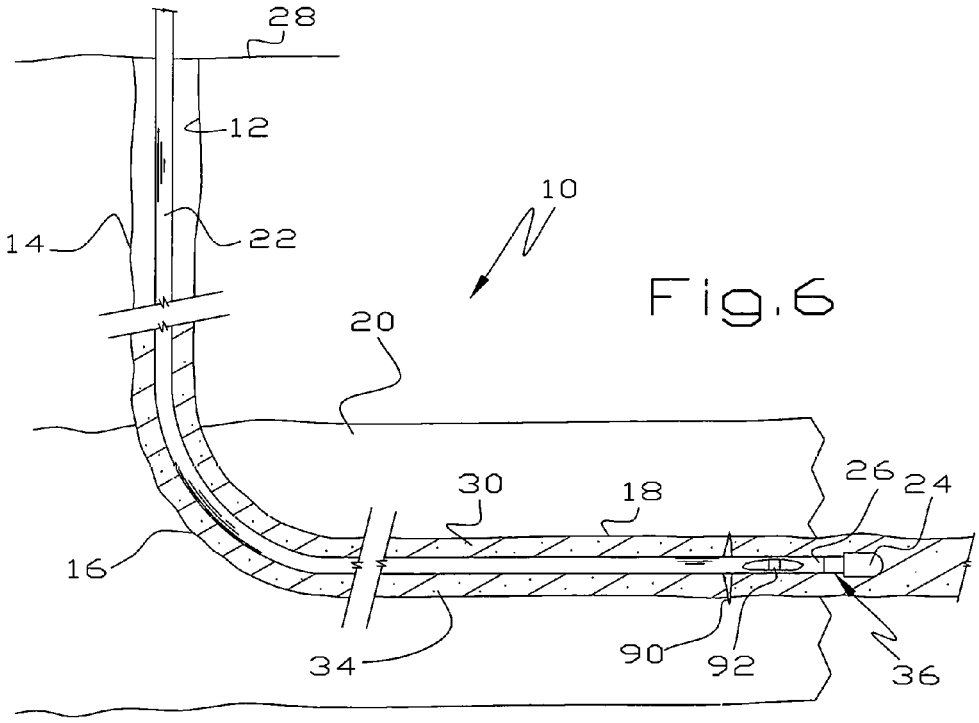
FIG. 6 is a view similar to FIG. 5 illustrating another early step in conducting a series of fracing operations in a horizontal well, certain parts being broken away to disclose a plug.

As shown in FIG. 6, if the sub 36 is located in an area where it is not desired to frac, as where the casing toe 26 is outside the hydrocarbon bearing formation 20, the formation adjacent the sub 36 can be pumped into so a perforating gun (not shown) can be pumped into the casing string 22 to an location where the first fracture is to be created. In this circumstance, it will be seen that the passages 50 allow liquid in front of the perforating gun to exit the casing 22 thereby allowing the perforating gun to be pumped to the casing toe 26. After shooting the first set of frac perforations 90 and retrieving the perforating gun with its wire line, a bridge plug or other suitable device 92 can be run into the casing 22 as shown in the broken away portion of FIG. 6 to isolate the passages 50 thereby directing the frac fluid through the desired frac perforations 90. In this situation, the first set of frac perforations 90 are nearer the surface 28 than the sub 36.

Horizontal hydrocarbon wells are typically fraced a number of times in the horizontal leg. This is accomplished, in any suitable manner, as by pumping perforating equipment through the casing string 22 to the location where the second fracture is to be created, perforating a second set of frac perforations, isolating the first set of frac perforations with a bridge plug or the like and then pumping a frac fluid through the second set of perforation. Typically, bridge plugs are pumped into the casing string with liquid in front of the bridge plug exiting through the passages 50 or through perforations that will be isolated by the bridge plug. This process is repeated to create as many fractures as desired. Those skilled in the art will recognize this description of frac operations as being typical of current fracing techniques.

For example, to create a second set of perforation, after the first perforations are fraced, second wire line perforating equipment can be placed in the casing string and a liquid pumped into the casing string to propel the second wire line perforating equipment toward the casing toe to a location spaced from the first perforations where the well was fraced, liquid in front of the second perforating equipment exiting the well bore through the first perforations. A second set of perforations can be created in the casing string with the second perforating equipment. A second wire line isolation tool can be placed in the casing string and a liquid pumped into the casing string to propel the second isolation tool toward the casing toe to a location between the first and second perforations and setting the second isolation tool to isolate the first perforations from the second perforations. The well can then be fraced through the second perforations.

Although the disclosed technique has particular advantages in horizontal wells, it is also suitable for use in vertical wells as suggested in FIG. 4 where a well 70 includes a more-or-less vertical well bore 72 extending through a hydrocarbon bearing formation 74 and a casing string 76 cemented in the well bore 72 by a cement sheath 78 in an annulus 80 between the casing string 76 and the well bore 72. FIG. 4 not only illustrates the disclosed technique in a vertical well, it also illustrates a slightly different type float equipment where a float shoe 82 is located on the bottom of the casing string 76 and a float collar 84 is located one or more casing joints 86 above the float shoe 82.

When the casing string 76 is run into and cemented in the well bore 72, a sub 88 of the same type shown in FIG. 2 is located in the casing string 76 above the float collar 84 at a location opposite the formation 74 which is desired to be fraced. When running the casing string 76 into the well bore 72, care is taken to position the sub 88 opposite the formation 74 to be fraced. After the cement sets up and the soluble plug or plugs in the sub 88 dissolve, a frac job can be conducted without requiring a perforating gun run thereby saving the time and cost to create a first set of frac perforations.

It will be seen that many modifications of the disclosed technique may be employed, as by placing the soluble plug in float equipment, such as a float shoe or float collar.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. A method of completing a hydrocarbon well in a well bore extending from a location on earth's surface and having a horizontal leg, comprising providing a passage through a wall of a casing string upstream of float equipment adjacent a casing toe of the casing string, the passage having a first ball seat for cooperating with a ball to prevent flow into the casing string and a second ball seat cooperating with the ball to prevent flow out of the casing string;

placing a soluble ball in the passage;

running the casing string into the horizontal leg and creating an annulus between the casing string and the well bore;

pumping cement into the casing string, out through the float equipment and into the annulus from the casing toe toward a heel of the well and displacing drilling fluid from the annulus to the surface location by pumping a liquid into the casing string that slowly dissolves the soluble ball; and after the cement sets up and after the soluble ball dissolves to provide at least one passage through the wall of the casing string, pumping an additional liquid through the at least one passage.

2. The method of claim 1 wherein pumping the additional liquid comprises placing perforating equipment in the casing string and then pumping the additional liquid into the casing string and thereby pumping the perforating equipment into the casing string and pushing the liquid ahead of the perforating equipment through the at least one passage, creating perforations in the casing string with the perforating equipment, isolating the perforations from the at least one passage and fracing the perforations.

3. The method of claim 2 further comprising, after the first perforations are fraced, placing a second wire line perforating equipment in the casing string and pumping an additional liquid into the casing string to propel the second perforating equipment toward the casing toe to a location spaced from the first perforations where the well was fraced, the additional liquid in front of the second perforating equipment exiting the well bore through the first perforations;

creating a second set of perforations in the casing string with the second perforating equipment;

placing a wire line isolation tool in the casing string at a location between the first mentioned and second perforations and setting the isolation tool to isolate the first perforations from the second perforations; and fracing the well through the second perforations.

4. The method of claim 1 wherein pumping the additional liquid comprises pumping frac fluid through the at least one passage and fracing a formation at a location adjacent the at least one passage.

5. The method of claim 4 further comprising, after the steps of claim 4, placing wire line perforating equipment in the casing string and pumping the additional liquid into the casing string to propel the perforating equipment toward the casing toe to a location spaced from the at least one passage, the liquid in front of the perforating equipment exiting the casing string through the passage;

creating perforations in the casing string with the perforating equipment;

placing a wire line isolation tool in the casing string at a location between the at least one passage and the perforations and setting the isolation tool to isolate the at least one passage from the perforations; and fracing the well through the perforations.

6. The method of claim 1 wherein the ball is soluble in water and wherein the liquid which displaces drilling fluid from the annulus is a water based liquid.

7. The method of claim 6 wherein the ball is soluble in a solution having a pH less than about three and the water based liquid comprises water and an acid.

8. The method of claim 1 wherein the casing string comprises a sub having the passage therein.

9. A method of completing a hydrocarbon well comprising providing a sub in a casing string upstream of float equipment adjacent a toe thereof, the sub providing a passage through a wall of the casing string, the passage having a first ball seat in the passage for cooperating with a ball to prevent flow into the casing string and a second ball seat in the passage cooperating with the ball to prevent flow out of the casing string; installing a soluble ball in the passage configured to resist cementing pressures and configured to dissolve after the cement sets up, running the casing string into the well, then cementing the casing string and sub in the well, then dissolving the soluble ball and then pumping liquid through the passage.

10. The method of claim 9 wherein the well comprises a horizontal leg and the sub is in the horizontal leg.

11. The method of claim 9 wherein the well is a vertical well.

12. The method of claim 9 wherein pumping liquid through the passage comprises fracing through the passage.

13. A hydrocarbon well having a well bore including a vertical leg and a horizontal leg, a casing string in the horizontal leg having a tubular wall providing a passage therethrough adjacent a casing toe of the casing string, the passage having therein a ball, a first ball seat for cooperating with the ball to prevent flow into the casing string and a second ball seat cooperating with the ball to prevent flow out of the casing string, the ball plugging the passage and being soluble in a completion liquid, and float equipment adjacent the casing toe and further from earth's surface than the passage, and a cement sheath substantially filling an annulus between the casing string and the well bore from adjacent the float equipment toward the earth's surface.

14. The hydrocarbon well of claim 13 wherein the casing string comprises a sub having the passage therein.

15. The hydrocarbon well of claim 13 wherein the passage is within a hundred feet of the float equipment.

16. The hydrocarbon well of claim 13 wherein the well includes a vertical leg and a horizontal leg and the passage is in the horizontal leg.

17. A method of completing a hydrocarbon well in a well bore extending from a location on earth's surface and having a horizontal leg, comprising providing a soluble element in a passage through a wall of a casing string upstream of float equipment adjacent a casing toe of the casing string;

running the casing string into the horizontal leg and creating an annulus between the casing string and the well bore;

pumping cement into the casing string, out through the float equipment and into the annulus from the casing toe toward a heel of the well and displacing drilling fluid from the annulus toward the surface location by pumping a liquid into the casing string that slowly dissolves the soluble element;

after the cement sets up and after the soluble element dissolves to provide at least one passage through the wall of the casing string, propelling perforating equipment into the casing string by pumping an additional liquid into the casing string and out through the at least one passage, creating first perforations through the casing string and then fracing the well through the first perforations;

after the first perforations are fraced, placing second wire line perforating equipment in the casing string and pumping liquid into the casing string to propel the second perforating equipment toward the casing toe to a location spaced from the first perforations, at least some additional liquid in front of the second perforating equipment exiting the well bore through the first mentioned perforations;

creating a second set of perforations in the casing string with the second perforating equipment, placing a wire line isolation tool in the casing string at a location between the first and second perforations and setting the isolation tool to isolate the first perforations from the second perforations; and fracing the well through the second perforations.

18. A method of completing a hydrocarbon well in a well bore extending from a location on earth's surface and having a horizontal leg, comprising providing a soluble element in a passage through a wall of a casing string upstream of float equipment adjacent a casing toe of the casing string;

running the casing string into the horizontal leg and creating an annulus between the casing string and the well bore;

pumping cement into the casing, out through the float equipment and into the annulus, from the casing toe toward a heel of the well and displacing drilling fluid from the annulus toward the surface location by pumping a water based liquid into the casing string that slowly dissolves the soluble element; and after the cement sets up and after the soluble element dissolves to provide at least one passage through the wall of the casing string, pumping perforating equipment through the casing string to a location adjacent the casing toe and pushing the water based liquid through the at least one passage;

creating perforations in the casing string at the location with the perforating equipment and then removing the perforating equipment from the well; and then fracing the well through the perforations.

19. The method of claim 18 further comprising placing a second wire line perforating equipment in the casing string and pumping additional liquid into the casing string to propel the second perforating equipment toward the casing toe to a location spaced from the first mentioned perforations where the well was fraced, at least some additional liquid in front of the second perforating equipment exiting the well bore through the first mentioned perforations;

creating a second set of perforations in the casing string with the second perforating equipment;

placing a wire line isolation tool in the casing string at a location between the first mentioned and second perforations and setting the isolation tool to isolate the first mentioned perforations from the second perforations; and fracing the well through the second perforations.

* * * * *